US012161276B2

(12) United States Patent
Jang

(10) Patent No.: US 12,161,276 B2
(45) Date of Patent: Dec. 10, 2024

(54) FLUID SUPPLY SYSTEM OF DOCKING STATION FOR MOVING DEVICE AND METHOD FOR CONTROLLING SAME

(71) Applicants: Hyundai Motor Company, Seoul (KR); Kia Corporation, Seoul (KR)

(72) Inventor: Seong Won Jang, Suwon-Si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 295 days.

(21) Appl. No.: 17/861,635

(22) Filed: Jul. 11, 2022

(65) Prior Publication Data

US 2023/0051316 A1 Feb. 16, 2023

(30) Foreign Application Priority Data

Aug. 11, 2021 (KR) ..... 10-2021-0106316

(51) Int. Cl.
*A47L 11/40* (2006.01)

(52) U.S. Cl.
CPC ..... *A47L 11/4083* (2013.01); *A47L 11/4002* (2013.01); *A47L 11/4011* (2013.01); *A47L 11/4016* (2013.01); *A47L 11/4025* (2013.01); *A47L 11/4091* (2013.01); *A47L 2201/024* (2013.01); *A47L 2201/026* (2013.01)

(58) Field of Classification Search
CPC ..... A47L 11/4083; A47L 11/4016; A47L 11/4025; A47L 2201/024; A47L 2201/026
See application file for complete search history.

(56) References Cited

U.S. PATENT DOCUMENTS

| | | | | |
|---|---|---|---|---|
| 5,715,568 | A | 2/1998 | Berfield et al. | |
| 8,770,012 | B2 * | 7/2014 | Yahashi | G01M 3/26 73/40 |
| 9,138,115 | B2 | 9/2015 | Stryker et al. | |
| 9,840,154 | B2 | 12/2017 | Kwa et al. | |
| 10,133,277 | B1 | 11/2018 | Carrasco Zanini et al. | |
| 10,709,308 | B2 | 7/2020 | Buehler et al. | |
| 11,109,729 | B2 * | 9/2021 | Juettner | A47L 11/145 |

(Continued)

FOREIGN PATENT DOCUMENTS

| | | |
|---|---|---|
| EP | 2658073 | 6/2020 |
| GB | 2435247 A | 8/2007 |

(Continued)

*Primary Examiner* — Timothy L Maust
(74) *Attorney, Agent, or Firm* — Morgan, Lewis & Bockius LLP

(57) ABSTRACT

A fluid supply system of a docking station for a moving apparatus includes a moving apparatus including a first storage tank configured to receive a fluid therein, a docking station into which the moving apparatus is selectively docked, the docking station including a second storage tank configured to receive the fluid therein and a pump configured to discharge a fluid received in the second storage tank, and a processor electrically connected to the pump and configured to determine, when the moving apparatus is docked to the docking station, whether the moving apparatus has been successfully docked, and to control the pump to operate with an operation load, when the processor concludes that the moving apparatus has been successfully docked into the docking station so that the fluid is supplied from the second storage tank to the first storage tank.

13 Claims, 6 Drawing Sheets

(56) References Cited

U.S. PATENT DOCUMENTS

| | | | | |
|---|---|---|---|---|
| 11,147,425 | B2 * | 10/2021 | Windmeisser | A47L 11/30 |
| 2005/0010330 | A1 | 1/2005 | Abramson et al. | |
| 2006/0069837 | A1 | 3/2006 | Zhang et al. | |
| 2012/0125363 | A1 | 5/2012 | Kim et al. | |
| 2012/0303190 | A1 | 11/2012 | Pfeiffer | |
| 2012/0323365 | A1 | 12/2012 | Taylor et al. | |
| 2013/0157565 | A1 | 6/2013 | Clement et al. | |
| 2014/0360832 | A1 | 12/2014 | Aldrich | |
| 2017/0043966 | A1 | 2/2017 | Witelson | |
| 2019/0168619 | A1 | 6/2019 | Hooker | |
| 2020/0345190 | A1 | 11/2020 | Buehler | |
| 2021/0053407 | A1 | 2/2021 | Smith et al. | |
| 2021/0054701 | A1 | 2/2021 | Holck | |

FOREIGN PATENT DOCUMENTS

| | | | |
|---|---|---|---|
| JP | 2008-254079 | A | 10/2008 |
| JP | 2017-507687 | | 3/2017 |
| KR | 10-0674564 | | 1/2007 |
| KR | 10-2007-0104472 | | 10/2007 |
| KR | 10-0919765 | B1 | 9/2009 |
| KR | 10-2016-0137889 | | 12/2016 |
| KR | 10-2019-0022458 | | 3/2019 |
| WO | WO2008/002027 | | 1/2008 |
| WO | WO2009/022929 | | 2/2009 |
| WO | WO2010/043640 | | 4/2010 |

* cited by examiner

FLUID SUPPLY SYSTEM OF DOCKING STATION FOR MOVING DEVICE AND METHOD FOR CONTROLLING SAME

CROSS REFERENCE TO RELATED APPLICATION

The present application claims priority to Korean Patent Application No. 10-2021-0106316, filed Aug. 11, 2021, the entire contents of which is incorporated herein for all purposes by this reference.

BACKGROUND OF THE PRESENT DISCLOSURE

Field of the Present Disclosure

Embodiments relate to a fluid supply system of a docking station for a moving device, wherein when a moving device is docked into a docking station, a fluid may be supplied to the moving device, fluid leakage may be detected, and the docking state may be checked.

Description of Related Art

There has recently been an increasing interest in autonomous moving devices. An autonomous moving device refers to a device having an autonomous driving technology applied thereto so that the same can move autonomously without direct manipulations by the user or occupant regarding whether or not to move, the direction of movement, the rate of movement, and the like. Autonomous moving devices may include, for example, autonomous vehicles, autonomous mobile robots, and robotic cleaners.

Moving devices for cleaning (for example, domestic robotic cleaners or automatic cleaning vehicles) are used in various fields. While autonomously traveling in a designated area, a moving device configured for cleaning may spray a washing liquid stored in an internal reservoir thereof and may clean a floor, a glass window, or a wall by rubbing or wiping the same with the washing liquid. The sprayed cleaning liquid may be collected back into the moving device configured for cleaning.

A moving device is required to dock into a docking station for a time period, depending on the situation. While docked into a docking station, for example, a moving device configured for cleaning may receive a washing liquid supplied from a reservoir and may discharge a collected washing liquid. The battery thereof may also be charged by the docking station.

When the moving device configured for cleaning automatically receives a liquid supplied from the docking station, there is concern that fluid supply may start even when docking is not completed.

Furthermore, even when docking is completed, the docking state may become anomalous during the fluid supply process, and the fluid may leak. Therefore, there is a demand for a technology capable of checking the docking state or detecting fluid leakage in connection with a docking station configured to supply a fluid.

The information included in this Background of the present disclosure section is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing a fluid supply system of a docking station for a moving apparatus, wherein when a moving apparatus is docked into a docking station, a fluid may be supplied after determining whether docking has successfully occurred, before supplying the fluid.

Furthermore, embodiments provide a fluid supply system of a docking station for a moving apparatus, wherein the docking state may be checked after fluid supply is started, and fluid leakage, if any, may be detected.

Problems to be solved through embodiments are not limited to the above-mentioned problems, and other problems not mentioned herein will be clearly understood from the specification and the appended drawings by those skilled in the art to which embodiments pertain.

To solve the above-mentioned problems, a fluid supply system of a docking station for a moving apparatus according to an exemplary embodiment of the present disclosure may include: a moving apparatus including a first storage tank configured to receive a fluid therein: a docking station into which the moving apparatus is selectively docked, the docking station including a second storage tank configured to receive the fluid therein and a pump configured to discharge the fluid received in the second storage tank; and a processor electrically connected to the pump and configured to determine, when the moving apparatus is docked to the docking station, whether the moving apparatus has been successfully docked, and control the pump to operate with an operation load, when the processor concludes that the moving apparatus has been successfully docked into the docking station so that the fluid is supplied from the second storage tank to the first storage tank.

The processor may control the pump to operate with a test operation load lower than the operation load to determine whether the moving apparatus has been successfully docked into the docking station.

Furthermore, while the pump operates with the test operation load, the processor may determine, according to an amount of the fluid discharged from the second storage tank and the amount of the fluid introduced into the first storage tank, whether the moving apparatus has been successfully docked into the docking station.

Processor may determine, when a difference between the amount of the fluid discharged from the second storage tank and the amount of the fluid introduced into the first storage tank is smaller than a predetermined amount, that the moving apparatus has been successfully docked into the docking station, and control the pump to operate with the operation load. Furthermore, the processor may determine, when the difference between the amount of the fluid discharged from the second storage tank and the amount of the fluid introduced into the first storage tank is greater than the predetermined amount, that the moving apparatus has not been successfully docked into the docking station, and transfer a signal to the moving apparatus to reattempt a docking thereof.

Furthermore, while the pump operates with the operation load, the processor may check, based on a flow rate of the first storage tank and a flow rate of the second storage tank, a docking state of the moving apparatus. To the present end, the moving apparatus may include a first detector electrically connected to the processor and configured to detect the amount of the fluid received in the first storage tank and to periodically transfer a signal to the processor. The docking station may include a second detector electrically connected to the processor and configured to detect an amount of the fluid received in the second storage tank and to periodically transfer a signal to the processor. The processor may periodically determine, according to the signals received from the first detector and the second detector, a flow rate of the first storage tank and a flow rate of the second storage tank.

The processor may determine that the docking state of the moving apparatus is an abnormal state when [equation 1] below is satisfied, and stop the operation of the pump when the abnormal state persists for a predetermined time period or longer than the predetermined time period, or when a configured number of times is exceeded, $$\sum_{k=1}^{n}(|B_k - B_{k-1}| - |A_k - A_{k-1}|) > \delta \quad \text{[equation 1]}$$

wherein $A_0$ is an initial amount of a fluid received in the first storage tank, $A_n$ is a value of an n-th signal received from the first detector, $B_0$ is an initial amount of a fluid received in the second storage tank, $B_n$ is a value of an n-th signal received from the second detector, and $\delta$ is a reference value.

Furthermore, when an amount of the fluid received in the first storage tank is equal to or greater than a first threshold value, or when an amount of the fluid received in the second storage tank is equal to or smaller than a second threshold value, the processor may stop the operation of the pump.

The fluid supply system may further include a leakage detector configured to detect a leakage of the fluid between the moving apparatus and the docking station.

The leakage detector may include a first circuit portion disposed on the moving apparatus and a second circuit portion disposed into the docking station, and the first circuit portion and the second circuit portion may be arranged, when the moving apparatus has been docked into the docking station, at a point at which the first circuit portion and the second circuit portion face each other. When a part of the fluid flows into a gap between the moving apparatus and the docking station, the first circuit portion and the second circuit portion may be electrically connected to each other to detect the leakage of the fluid.

Furthermore, the moving apparatus may be an autonomous moving apparatus which drives autonomously. The moving apparatus may autonomously dock, when a docking thereof is started, into the docking station, and may reattempt the docking into the docking station when the operation of the pump is stopped when the processor concludes that a docking state of the moving device into the docking station is abnormal.

The moving apparatus may further include a third storage tank configured to receive wastewater therein. A fluid may be discharged from the third storage tank when the moving apparatus is docked into the docking station. The processor may detect the time required for discharging a fluid in the third storage tank and record an abnormal log when the required time is equal to or greater than a predetermined time period.

To solve the above-mentioned problems, a method for controlling a fluid supply system of a docking station for a moving apparatus according to another exemplary embodiment of the present disclosure may include: starting, by a moving apparatus, a docking of the moving apparatus into a docking station: determining, when the moving apparatus has been docked, whether the moving apparatus has been successfully docked into the docking station; and controlling a pump to operate with an operation load, when the moving apparatus has been successfully docked so that a fluid is supplied from a second storage tank of the docking station to a first storage tank of the moving apparatus.

In the determining of whether the moving apparatus has been successfully docked, the pump may be controlled to operate with a test operation load lower than the operation load to determine whether the moving apparatus has been successfully docked.

The method for controlling a fluid supply system of a docking station for a moving apparatus may further include checking, based on a flow rate of the first storage tank and a flow rate of the second storage tank, a docking state of the moving apparatus while the pump operates with the operation load.

A fluid supply system of a docking station for a moving apparatus and a method for controlling the same, according to various exemplary embodiments of the present disclosure, can confirm, before a fluid is supplied to a moving apparatus, whether docking has successfully occurred, through a pump test operation. This is advantageous in that the confirmation method is simple, and fluid supply may be started after docking is completed.

Furthermore, the docking state may be checked while a fluid is supplied from the docking station to the moving apparatus, and fluid leakage may be detected, ensuring stable fluid supply and preventing fluid waste.

Advantageous effects obtainable from embodiments are not limited to the above-mentioned advantageous effects, and other advantageous effects not mentioned herein will be clearly understood from the specification and the appended drawings by those skilled in the art to which embodiments pertain.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1:
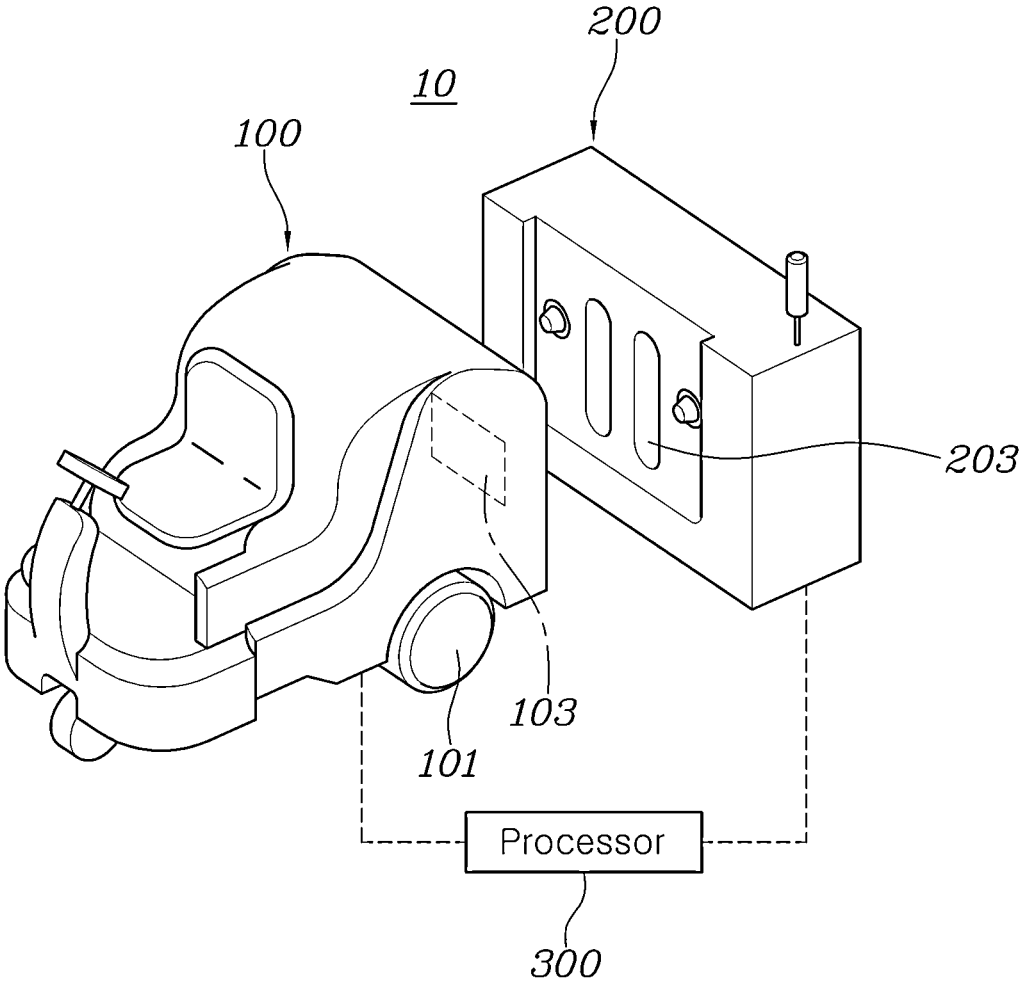
FIG. 1 is a view exemplarily illustrating an exemplary embodiment of a fluid supply system of a docking station for a moving apparatus.

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

In the present disclosure, general terms that have been widely used nowadays are selected, if possible, in consideration of functions of the present disclosure, but non-general terms may be selected according to the intentions of technicians in the art, precedents, or emergence of new technologies, etc. Some terms may be arbitrarily chosen by the present applicant. In the instant case, the meanings of these terms will be explained in corresponding parts of the present disclosure in detail. Thus, the terms used in the present disclosure should be defined not based on the names thereof but based on the meanings thereof and the whole context of the present disclosure.

Furthermore, unless explicitly described to the contrary, the word "include" will be understood to imply the further inclusion of stated elements but not the exclusion of any other elements. Furthermore, the terms "-part", "-unit", "-module", and the like described in the specification mean units for processing at least one function and operation and may be implemented by hardware components or software components and combinations thereof.

Embodiments will be described in detail below so that those of ordinary skill in the art may easily implement them. However, embodiments may be implemented in various different types and are not limited to various exemplary embodiments described therein.

Hereinafter, embodiments will be described in detail with reference to the accompanying drawings.

FIG. 1 is a view exemplarily illustrating an exemplary embodiment of a fluid supply system of a docking station for a moving device.

Referring to FIG. 1, a fluid supply system 10 of a docking station for a moving device may include a moving device 100, a docking station 200, and a processor 300.

In embodiments, the moving device 100 may be a device configured to determine a movement direction and to be movable by itself without a user's or passenger's manipulation. For example, the moving device 100 may be an autonomous vehicle, an autonomous mobile robot, or a robot cleaner. The moving device 100 not only may move by itself but also, for docking by itself, may move to the docking station 200 and may be connected to the docking station 200.

Furthermore, the moving device 100 of FIG. 1 is illustrated in a form of a vehicle, but is not limited thereto. For example, the moving device 100 may be a small robot cleaner or a robot cleaner having a human form.

The moving device 100 may include a driving unit 101, controller (102 of FIG. 2), and a connection portion 103.

The driving unit 101 may mean a means for moving the moving device 100. In other words, the moving device 100 may be configured to move in accordance with an operation of the driving unit 101. The driving unit 101 may include a movement means, such as a wheel of an autonomous vehicle and a walking means of an autonomous mobile robot, configured for adjusting a position of the moving device 100. Furthermore, though not illustrated in FIG., the driving unit 101 may include a device such as motor configured for providing power to a movement means, an engine, a steering mechanism for adjusting a direction of a movement means, or a steering wheel.

The controller 102 may be configured to control the driving unit 101 and thus to control a movement of the moving device 100. The controller 102 may be configured to control an overall operation of the driving unit 101, such as whether the driving unit 101 starts an operation, an operation direction thereof, and an operation speed thereof. The controller 102 may be configured to receive signals from various detectors included in the autonomous moving device 100, to detect a movement area or obstacles, and thus to search an optimal movement path for the moving device 100. Furthermore, the controller 102 may be configured to control the driving unit 101 so that the moving device 100 moves along the searched movement path.

The moving device 100 may include at least one the connection portion 103. When the moving device 100 is docked into the docking station 200, the connection portion 103 may be connected to a docking portion 203 of the docking station 200 so that the docking is achieved. The docking portion 203 may mean an area in which the moving device 100, in the docking station 200, has been docked. For example, the connection portion 103 may be a ball-locking structure configured for being inserted in the docking portion 203 and being physically fastened to the locking portion 203 by a locking ball. Furthermore, the connection portion 103 and the docking portion 203 may be connected to each other in a contact point communication manner in which the connection portion 103 is connected to the docking portion 203 to transmit or receive a signal. However, the connection method mentioned above is merely an exemplary embodiment and is not limited thereto.

The moving device 100 may start a docking if a docking condition is satisfied. For example, in a case of a cleaning vehicle performing an autonomous cleaning function, the moving device 100 may start a docking if a received amount of a fluid such as a washing liquid is equal to or less than a predetermined value.

When the moving device 100 is docked, the docking station 200 may be configured to perform a specific function. For example, if the moving device 100 is a cleaning vehicle, the docking station 200 may be configured to fill the inside of the moving device 100 with a fluid such as a washing liquid. Furthermore, in a state of having been docked into the docking station 200, the moving device 100 may be configured to discharge wastewater received in the moving device 100.

If the moving device 100 has been docked into the docking station 200, the processor 300 may be configured to control the moving device 100 and/or the docking station 200 to perform a specific function, and to check the docking state. The processor 300 may be provided in the moving device 100, may be provided in the docking station 200, and may be provided separately with the moving device 100 and the docking station 200.

Elements related to the exemplary embodiments are illustrated in the moving device 100 and the docking station 200. Accordingly, it will be understood by a person skilled in the art related to the exemplary embodiments that other common elements besides the elements illustrated in FIG. 1 may be further included in the fluid supply system 10 of a docking station for a moving device.

Figure 2:
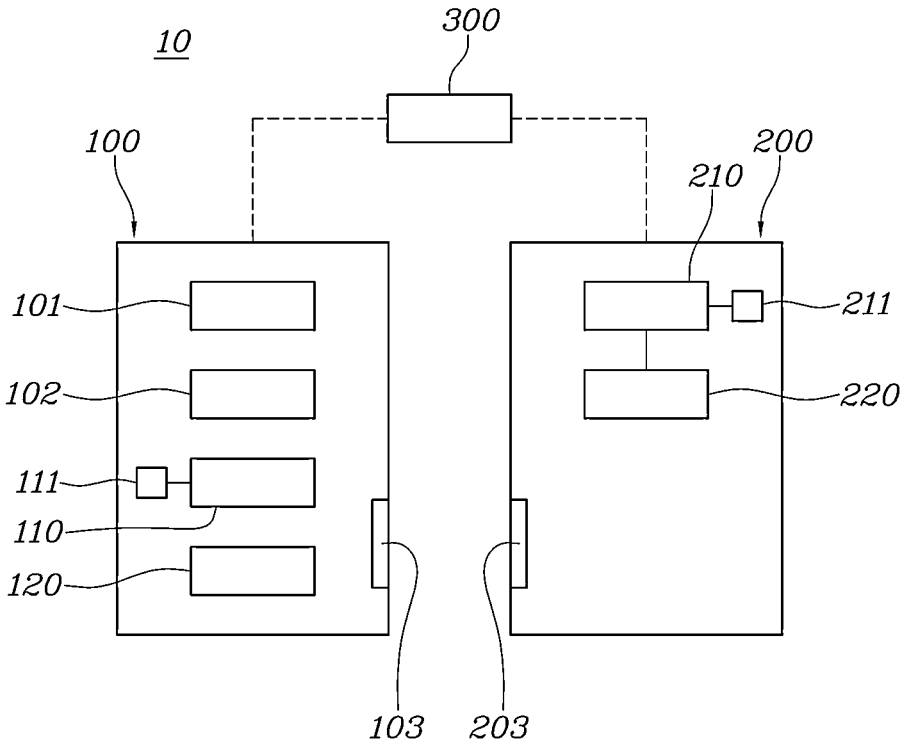
FIG. 2 is a schematic block diagram illustrating a fluid supply system of a docking station for a moving apparatus according to an exemplary embodiment of the present disclosure.

FIG. 2 is a schematic block diagram illustrating a fluid supply system of a docking station for a moving device according to an exemplary embodiment of the present disclosure.

Referring to FIG. 2, a fluid supply system 10 of a docking station for a moving device according to an exemplary embodiment of the present disclosure may include a moving device 100 including a first storage tank 110 and a second storage tank 210, a docking station 200 including a third storage tank 120 and a pump 220, and a processor 300.

The first storage tank 110 may be configured to receive a fluid therein. The description that the first storage tank 110 "receives a fluid" therein may mean that the first storage tank 110 has a function for simply receiving a fluid such as a purpose of a container, and the first storage tank 110 has a component therein such as a porous structure impregnated with a fluid. The above-mentioned description may be equally applied to the second storage tank 210 and the third storage tank 120 described below.

The fluid received in the first storage tank 110 may be a washing liquid used for cleaning. When the moving device 100 moves in a predetermined area to clean, the first storage tank 110 may be configured to spray a washing liquid at a predetermined speed. The moving device 100 may be configured to spray a washing liquid in the first storage tank 110 along a movement path, and may include tools for rubbing or wiping a sprayed washing liquid.

The second storage tank 210 may be configured to receive wastewater therein. The wastewater may be the washing liquid collected after being sprayed from the first storage tank 110. For example, the moving device 100 may be configured to draw the washing liquid used for a cleaning, the drawn in washing liquid may flow into the second storage tank 210. The moving device 100 may include a means for drawing the sprayed washing liquid.

The third storage tank 120 may be configured to receive a fluid therein. The fluid received in the third storage tank 120 may be the same as the fluid received in the first storage tank 110. When the moving device 100 has been docked into the docking station 200, the fluid received in the third storage tank 120 may be supplied into the first storage tank 110.

The pump 220 may be configured to discharge a fluid received in the third storage tank 120 to the outside. When an operation electric power is applied to the pump 220, the pump may be operated with an operation load to apply pressure to the third storage tank 120. When pressure is applied to the third storage tank 120, the fluid received therein may be discharged to the outside.

The processor 300 may be configured to control an overall operation of the docking station 200. When the moving device 100 is docked, the processor 300 may be configured to determine whether the moving device 100 has been successfully docked. The description that "the moving device has been successfully docked" may mean that when the fluid discharged from the third storage tank 120 is supplied to the first storage tank 110, by a normal connection between the connection portion 103 and the docking station 203, the discharged fluid does not leak, or the leakage amount of a fluid is equal to or less than a predetermined amount. In other words, if the moving device 100 has not been successfully docked, the fluid discharged from the third storage tank 120 may leak to a gap between the moving device 100 and the docking station 200.

Furthermore, the processor 300 may be configured to apply electric power to the pump 220 and to control the pump 220 to operate with an operation load. But not illustrated in FIG., the docking station 200 may include an electric power storage device configured for supplying electric power to the pump 220. When the pump 220 operates with an operation load, a fluid is supplied from the third storage tank 120 to the first storage tank 110 to fill the first storage 110 with a fluid.

Furthermore, when the moving device 100 is docked into the docking station 200, a fluid is discharged from the second storage tank 210 to the outside of the moving device 100. The second storage tank 210 may include an outlet of which at least a part is opened when the moving device 100 has been docked into the docking station 200. The outlet may be opened by a control of the processor 300 or may be opened by a physical connection with the docking station 200.

The process 300 may be configured to detect the time required for discharging a fluid in the second storage tank 210. If the required time is equal to or greater than a predetermined time period, the processor 300 may be configured to determine that there is a problem in the outlet of the second storage tank 210, to record an abnormal log, and to transmit a sound alarm or a visual alarm.

Figure 3:
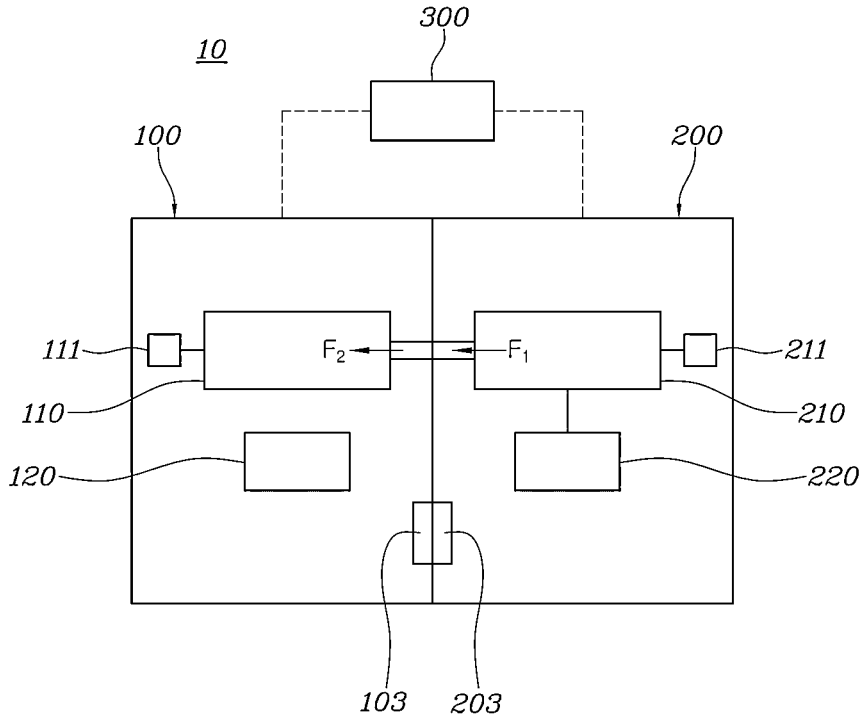
FIG. 3 is a schematic view exemplarily illustrating a state of determining whether a moving apparatus of a fluid supply system of a docking station for a moving apparatus according to an exemplary embodiment has been successfully docked into a docking station.

FIG. 3 is a schematic view exemplarily illustrating a state of determining whether a moving device of a fluid supply system of a docking station for a moving device according to an exemplary embodiment has been successfully docked into a docking station.

Referring to FIG. 3, when a moving device 100 has been docked into the docking station 200, a processor 300 may be configured to control the pump 220 to operate with a test operation load, to determine whether the moving device 100 has been successfully docked into the docking station 200. The test operation load may mean a load in which the pump 220 operates with the load lower than a normal operation load. When the pump 220 operates with the test operation load, a small amount of a fluid may be supplied from the third storage tank 120 to the first storage tank 110.

While the pump 220 operates with a test operation load, the processor 300 may be configured to determine, based on the amount $F_1$ of a fluid discharged from the third storage tank 120 and the amount $F_2$ of a fluid introduced into the first storage tank 110, whether the moving device 100 has been successfully docked into the docking station 200. Tough not illustrated in FIGs., a flow detector for detecting a flow rate of a fluid may be provided in the moving device 100 and/or the docking station 200. If the moving device 100 has been successfully docked into the docking station 200, the amount $F_1$ of a fluid discharged from the third storage tank 120 and the amount $F_2$ of a fluid introduced into the first storage tank 110 are equal to, or the difference therebetween may be very small.

Therefore, if a difference between the amount $F_1$ of a fluid discharged from the third storage tank 120 and the amount $F_2$ of a fluid introduced into the first storage tank 110 is smaller than a predetermined amount, the processor 300 may be configured to determine that the moving device 100 has been successfully docked into the docking station 200. The predetermined amount which is a determination reference may be appropriately set according to the capacity of the first storage tank 110 and the third storage tank 120, the performance of the pump 220, the type of a fluid, and the like.

If it is determined that the moving device 100 has been successfully docked into the docking station 200, the processor 300 may be configured to control the pump 220 to operate with an operation load so that a fluid is supplied from the third storage tank 120 to the first storage tank 110.

Furthermore, if a difference between the amount $F_1$ of a fluid discharged from the third storage tank 120 and the amount $F_2$ of a fluid introduced into the first storage tank 110 is greater than a predetermined amount, the processor 300 may be configured to determine that the moving device 100 has not been successfully docked into the docking station 200. If it is determined that the moving device 100 has not been successfully docked into the docking station 200, the processor 200 may be configured to control to stop the operation of the pump 220 and to transfer a signal the moving device 100 to reattempt a docking thereof.

For example, in a case where the moving device 100 is a moving device 100 autonomously driving, a signal of reattempting a docking may be transmitted to the controller 102 of the moving device 100, and the controller 102 may be configured to receive the signal and to control the driving unit 101 to adjust a position of the moving device 100. Furthermore, the processor 300 may be configured to transmit a sound alarm or a visual alarm indicating that the moving device 100 has not been successfully docked into the docking station 200. The moving device 100 and/or the docking station 200 may include a speaker for sending a sound alarm and a display for displaying a visual alarm.

In an exemplary embodiment of the present disclosure, the processor 300 may be configured to control the pump 220 to operate with a test operation load lower than an operation load and move a small amount of a fluid, and therefore whether the moving device 100 has been successfully docked into the docking station 200 is determined. Accordingly, a fluid leakage which may occur due to the initiation of supply of a fluid in an abnormal docking state, and failures of the moving device 100 and the docking station 200 may be prevented in advance. Furthermore, because only a small amount of a fluid moves, there is an advantage that the determination method is very simple.

Figure 4A:
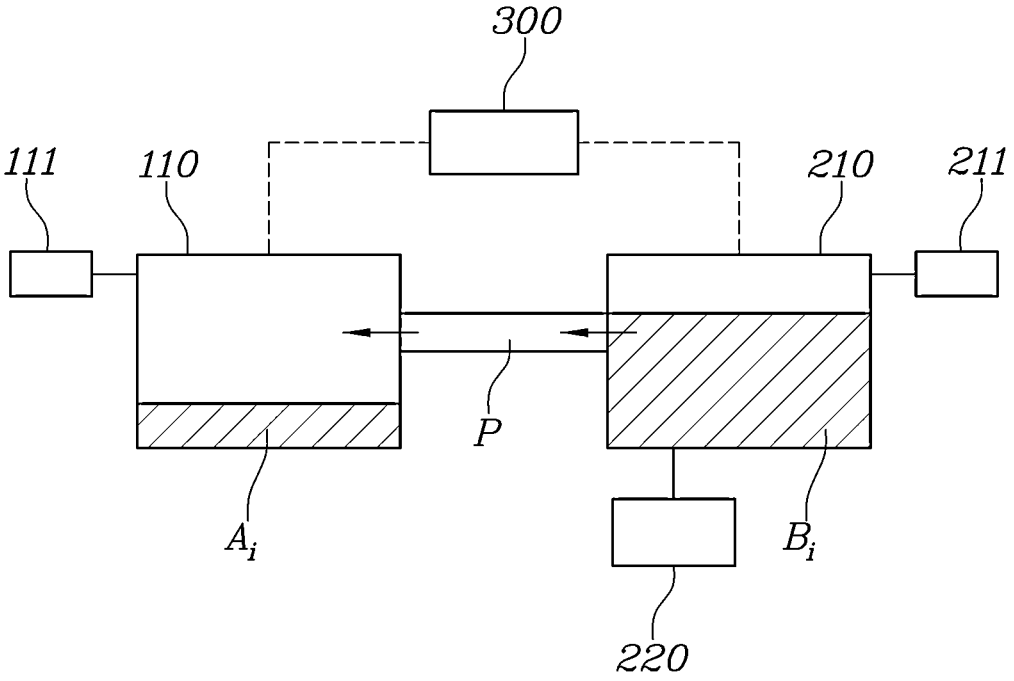
FIG. 4A, FIG. 4B and FIG. 4C are schematic views exemplarily illustrating a state of supplying a fluid from a third storage tank to a first storage tank of a fluid supply system of a docking station for a moving apparatus according to an exemplary embodiment of the present disclosure, respectively.
Figure 4B:
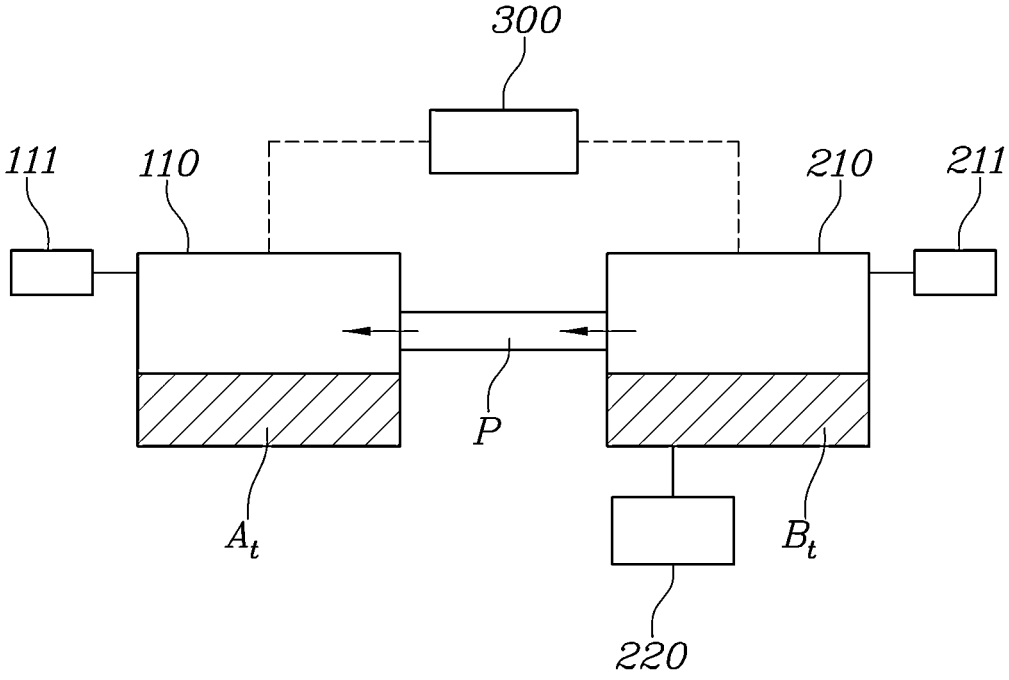
Figure 4C:
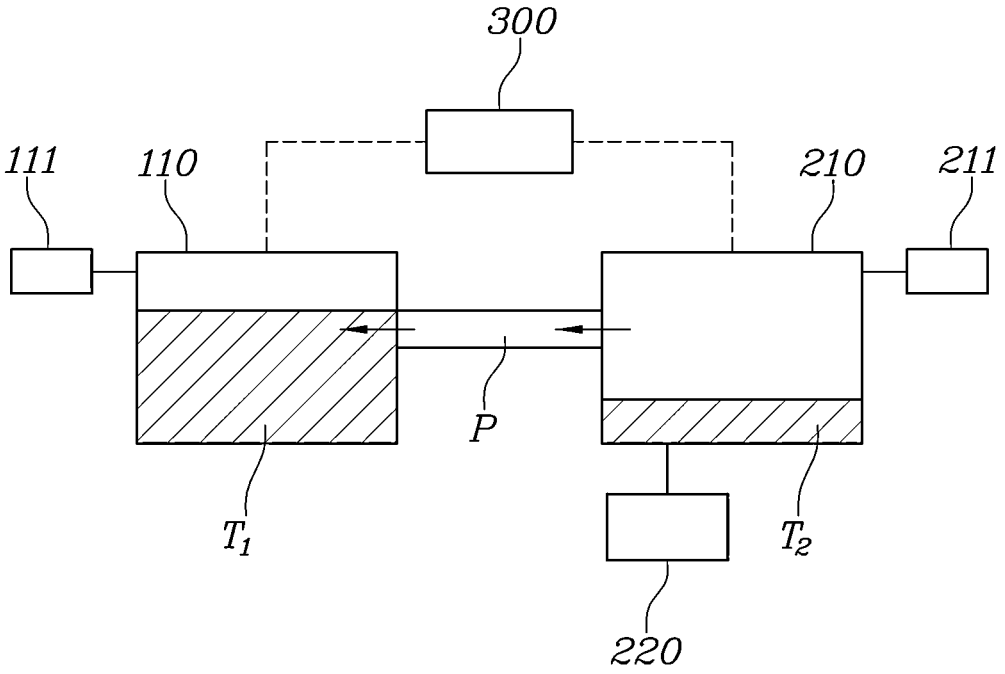

FIG. 4A, FIG. 4B and FIG. 4C are schematic views exemplarily illustrating a state of supplying a fluid from a third storage tank to a first storage tank of a fluid supply system of a docking station for a moving device according to an exemplary embodiment of the present disclosure, respectively.

Referring to FIG. 4A to FIG. 4C, when the moving device 100 has been docked into the docking station 200, the first storage tank 110 and the third storage tank 120 may fluid-communicate with each other. When the moving device 100 has been docked into the docking station 200, the first storage tank 110 and the third storage tank 120 may fluid-communicate with each other by a connection pipe P. The pump 220 may be configured to discharge a fluid received in the third storage tank 120 to the connection pipe P, and the discharged fluid may flow through the connection pipe P and then may be introduced into the first storage tank 110.

Furthermore, referring to FIG. 2, FIG. 3 and FIG. 4C, the fluid supply system 10 of a docking station for a moving device according to an exemplary embodiment of the present disclosure may include detectors 111 and 211 configured to detect an amount of a fluid received in the storage tanks. The fluid supply system may include a first detector 111 configured to detect an amount of a fluid received in the first storage tank 110 and a second detector 211 configured to detect an amount of a fluid received in the third storage tank 120.

FIG. 4A is a schematic view exemplarily illustrating a time point at which the supply of a fluid starts from the third storage tank 120 to the first storage tank 110.

When the pump 220 starts an operation with an operation load, the processor 300 may be configured to receive signals about the amount of a fluid received therein from the first detector 111 and the second detector 211 and then to receive same. In other words, the processor 300 may be configured to identify the amount $A_i$ of a fluid received in the first storage tank 110 and the amount Bi of a fluid received in the third storage tank 120 at the time point at which the supply of a fluid starts. The detectors 111 and 211 may employ various methods configured for checking a fluid movement and an appropriate detector relevant thereto, such as a flow detector for directly measuring a flow rate, a water level detector for detecting fluctuations of a water level in a storage tank to identify a flow rate change, or a weight detector for detecting a change in weight of a storage tank to identify a flow rate change.

FIG. 4B is a schematic view exemplarily illustrating a time point at which a predetermined time period has elapsed after the supply of a fluid starts from the third storage tank 120 to the first storage tank 110.

When the pump 220 operates with an operation load, a fluid may flow from the third storage tank 120 to the first storage tank 110 through the connection pipe P. Accordingly, when a predetermined time period has elapsed after the supply of a fluid starts from the third storage tank 120 to the first storage tank 110, the amount of a fluid received in the first storage tank 110 may increase, and the amount of a fluid received in the third storage tank 120 may decrease.

After the pump 220 operates with an operation load, the processor 300 may be configured to receive, at every predetermined time period, signals about the amount of a fluid from the first detector 111 and the second detector 211 and then to record same. In other words, the processor 300 may be configured to identify, at every predetermined time period after the supply of a fluid starts, the amount $A_t$ of a fluid received in the first storage tank 110 and the amount $B_t$ of a fluid received in the third storage tank 120.

While the pump 220 operates with an operation load, the processor 300 may be configured to check, based on the flow rate of the first storage tank 110 and the flow rate of the third storage tank 120, a docking state of the moving device 100. The flow rate of the first storage tank 110 may mean the amount of a fluid introduced into the first storage tank 110, and the flow rate of the third storage tank 120 may mean the amount of a fluid discharged from the third storage tank 120.

The processor 300 may be configured to determine a flow rate of the first storage tank 110 with respect to a predetermined time interval through the amount of a fluid received in the first storage tank 110, which is measured by the first detector 111 at every predetermined time period.

The processor 300, likewise, may be configured to determine a flow rate of the third storage tank 120 with respect to a predetermined time interval through the amount of a fluid received in the third storage tank 120, which is measured by the second detector 211 at every predetermined time period.

For example, the processor 300 may be configured to determine a flow rate of the first storage tank 110 for a predetermined time period through a difference $A_t$-$A_i$ between the amount $A_i$ of a fluid received in the first storage tank 110 at the time point at which the supply of a fluid starts and the amount $A_t$ of a fluid received in the first storage tank 110 at the time point at which a predetermined time period has elapsed after the supply of a fluid starts. The processor 300, likewise, may be configured to determine a flow rate of the third storage tank 120 for a predetermined time period through a difference $B_t$-Bi between the amount Bi of a fluid received in the third storage tank 120 at the time point at which the supply of a fluid starts and the amount $B_t$ of a fluid received in the third storage tank 120 at the time point at which a predetermined time period has elapsed after the supply of a fluid starts.

Furthermore, the processor may be configured to determine a flow rate of the first storage tank 110 with respect to a predetermined time interval through a difference between the amount of a fluid, which is measured by a first detector 111 at a specific time point and the amount of a fluid, which is measured by the first detector 111 at a time point immediately before the specific time point.

The processor 300 may be configured to receive, at every predetermined time period, signals about the amount of a fluid from the first detector 111 and the second detector 211 and then to record same. Accordingly, the processor 300 may be configured to identify, at every predetermined time period, a flow rate of the first storage tank 110 and a flow rate of the second storage tank 120.

The processor 300 may be configured to check a docking state of the moving device 100 through a difference between the flow rate of the first storage tank 110 and the flow rate of the second storage tank 120. The processor 300 may be configured to determine that a docking state of the moving device 100 is an abnormal state if [equation 1] below is satisfied:

$$\sum_{k=1}^{n}(|B_k - B_{k-1}| - |A_k - A_{k-1}|) > \delta, \quad \text{[equation 1]}$$

wherein $A_0$ is an initial amount of a fluid received in the first storage tank 100, An is a value of an n-th signal received from the first detector 111, $B_0$ is an initial amount of a fluid received in the third storage tank 120, $B_n$ is a value of an n-th signal received from the second detector 211, and δ is a reference value.

In the [equation 1], when the moving device 100 is not correctly docked, the reference value may be set from an amount of a fluid leaked into the outside without a fluid discharged from the third storage tank 120 being introduced into the first storage tank 110. For example, the reference value may be zero or more, and may be less than 5% of the amount of a fluid discharged from the third storage tank 120 per unit hour.

If a docking state of the moving device 100 is normal, the flow rate of the first storage tank 100 and the flow rate of the third storage tank 120 may be equal to each other, or a difference therebetween may be very small. Accordingly, when a docking state of the moving device 100 is normal, the difference between the amount $B_n$-$B_{n-1}$ of a fluid discharged from the third storage tank 120 per unit hour and the amount $A_n$-$A_{n-1}$ of a fluid introduced into the first storage tank 110 per unit hour may be zero or may be very small, and thus the [equation 1] may not be satisfied.

On the other hand, if a docking state of the moving device 100 is abnormal, there may occur a meaningful difference between the flow rate of the third storage tank 120 and the flow rate of the first storage tank 110. Accordingly, when a docking state of moving device 100 is normal, a difference between the amount $B_n$-$B_{n-1}$ of a fluid discharged from the third storage tank 120 per unit hour and the amount $A_n$-$A_{n-1}$ of a fluid introduced into the first storage tank 110 per unit hour may be a predetermined amount or more. When a value that the corresponding differences are accumulated is greater than the reference value, the [equation 1] may be satisfied.

When the [equation 1] may be satisfied, the processor 300 may be configured to determine that a docking state is abnormal state, and if the abnormal state persists for a predetermined time period or longer than the predetermined time period, or number of times of the abnormal state exceeds a predetermined number, the processor may be configured to stop the operation of the pump 220. Even though the [equation 1] may be satisfied, it may be a state in which a fluid leakage occurs due to a temporary docking failure. Accordingly, if the time thereof or number of times thereof satisfied by the [equation 1] is a predetermined time period or more, or a predetermined number or more, the processor 300 may be configured to determine that there is a problem in a docking of a moving device 100 other than a temporary docking failure and may be configured to stop the operation of the pump 220, stopping the supply of a fluid.

FIG. 4C is a schematic view exemplarily illustrating a state in which the supply of a fluid is stopped if the amount of a fluid received in the first storage tank 110 is equal to or greater than a first threshold value $T_1$ and the amount of a fluid received in the third storage tank 120 is equal to or less than a second threshold value $T_2$.

If the amount of a fluid received in the first storage tank 110 is equal to or greater than a first threshold value $T_1$, the processor 300 may be configured to control the pump 220 to stop an operation of the pump 220. Furthermore, when the amount of a fluid received in the third storage tank 120 is equal to or less than a second threshold value $T_2$, the processor 300 may be configured to control the pump 220 to stop an operation of the pump 220.

Therefore, it may be prevented that a fluid overflows due to a fluid excessively supplied to the first storage tank 110. Furthermore, if a fluid to be discharged to the third storage tank 120 is not sufficient, power waste or device damage which may occur due to the operation of the pump 220 may be prevented.

The first threshold value $T_1$ and the second threshold value $T_2$ may be appropriately set according to the total capacity of the first storage tank 110 and the third storage tank 120. For example, the first threshold value $T_1$ may be about 70% to 95% of the capacity of the first storage tank 110, and the second threshold value $T_2$ may be less than about 20% of the capacity of the third storage tank 120.

Figure 5A:
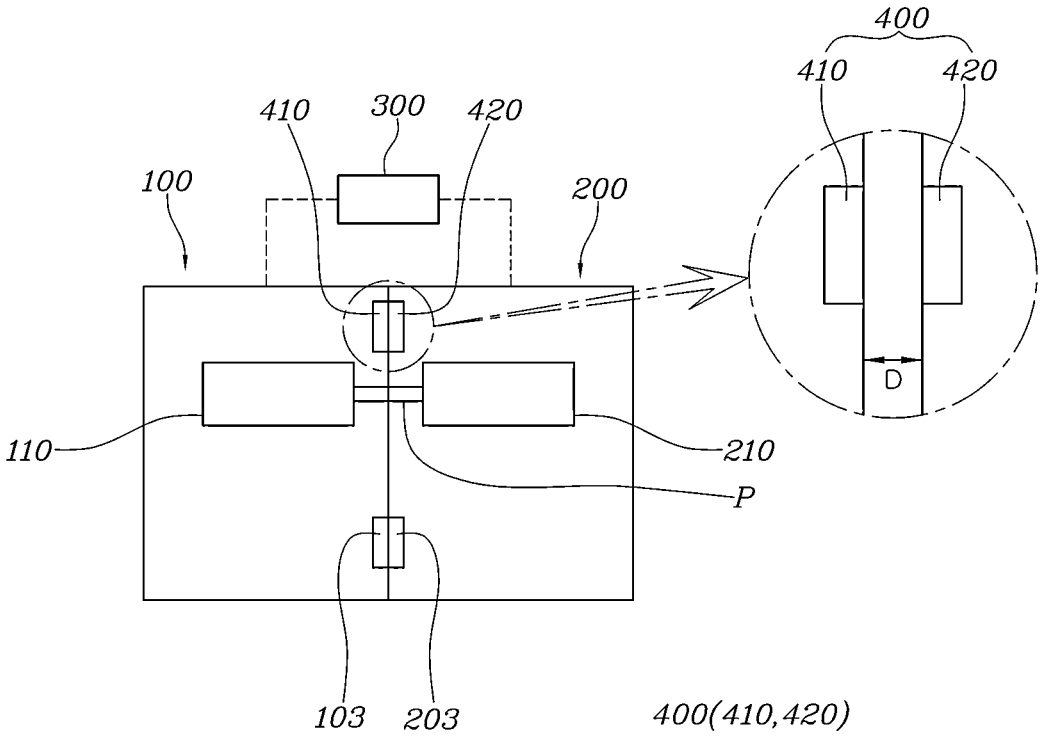
FIG. 5A and FIG. 5B are views for explaining a method for detecting fluid leakage according to a fluid supply system of a docking station for a moving apparatus according to an exemplary embodiment of the present disclosure, respectively.
Figure 5B:
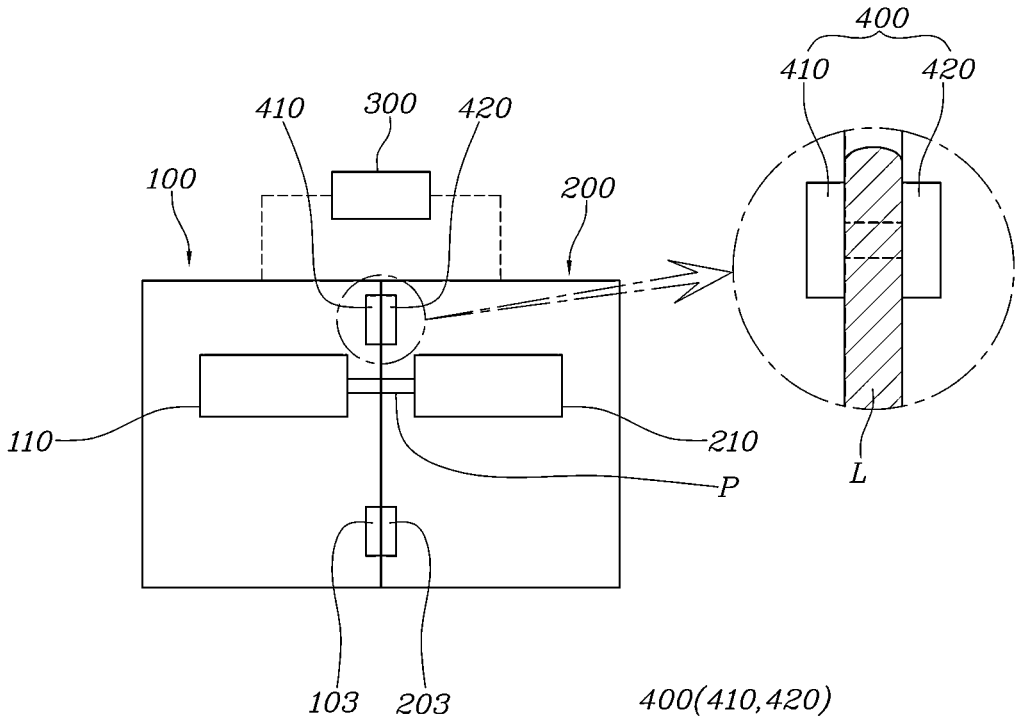

FIG. 5A and FIG. 5B are views for explaining a method for detecting fluid leakage according to a fluid supply system of a docking station for a moving device according to an exemplary embodiment of the present disclosure, respectively.

Referring to FIG. 5A and FIG. 5B, a fluid supply system 10 of a docking station for a moving device according to an exemplary embodiment of the present disclosure may include a leakage detector 400 configured to detect a fluid flowing between a moving device 100 and a docking station 200.

The leakage detector 400 may include a first circuit portion 410 disposed on the moving device 100 and a second circuit portion 420 disposed on the docking station 200. When the moving device 100 is docked into the docking station 200, the first circuit portion 410 and the second circuit portion 420 may be arranged at a point at which the first circuit portion and the second circuit portion face to each other.

FIG. 5A illustrates a state in which a fluid does not leak. Referring to FIG. 5A, when the moving device 100 has been docked into the docking station 200, a minute gap D may exist between the moving device 100 and the docking station 200. Accordingly, when the moving device 100 is docked into the docking station 200, the first circuit portion 410 and the second circuit portion 420 may be spaced from each other by the minute gap D. Accordingly, in a state where a fluid does not leak, the first circuit unit 410 and the second circuit unit 420 may not be electrically connected to each other.

FIG. 5B illustrates a state in which a fluid has leaked. Referring to FIG. 5B, when a fluid leaks, the leaked fluid may flow between the moving device 100 and the docking station 200, and thus the first circuit portion 410 and the second circuit unit 420 may be electrically connected to each other by the leaked fluid L. In other words, a contact point circuit may be formed between the first circuit portion 410 and the second circuit unit 420 by the leaked fluid L. The leakage detector 400 may be configured to detect as a fluid has leaked when the first circuit portion 410 and the second circuit unit 420 are electrically connected.

The processor 300 may be configured to receive a signal that a fluid has leaked from the leakage detector 400, and in the instant case, to transmit a sound alarm or a visual alarm. Furthermore, the leakage detector 400 may include a material configured for transferring, by the capillarity, the leaked fluid L to the first circuit portion 410 and the second circuit portion 420. For example, the leakage detector 400 may include at least one of cotton fiber, ceramic fiber, glass fiber, porous ceramics, cellulose, polyester, and polyamide which can absorb and transfer a fluid. Furthermore, a wick connected to a connection pipe P and the leakage detector 400 may be provided.

Figure 6:
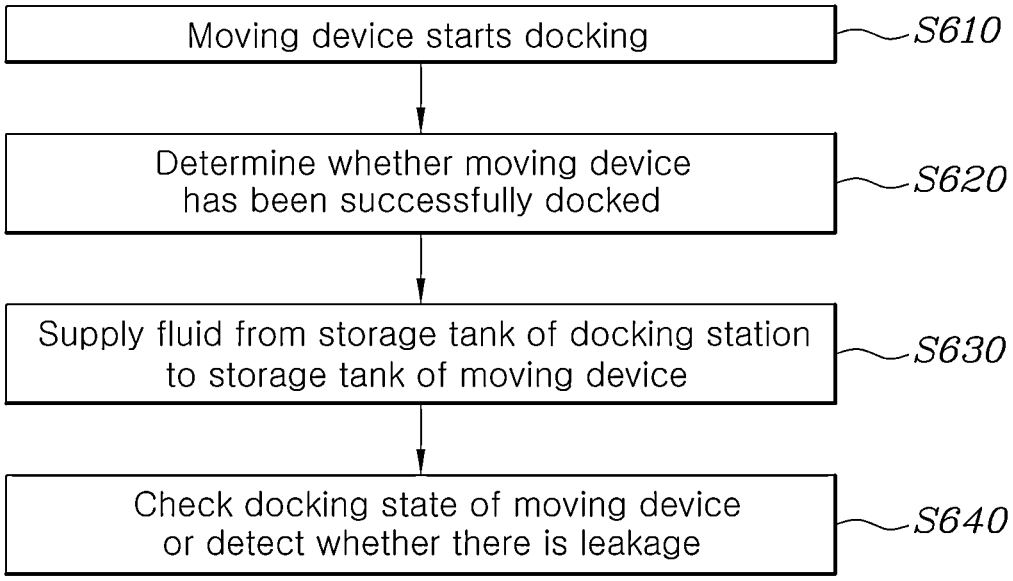
FIG. 6 is a flowchart of a method of controlling a fluid supply system of a docking station for a moving apparatus according to another exemplary embodiment of the present disclosure.

FIG. 6 is a flowchart of a method of controlling a fluid supply system of a docking station for a moving device according to another exemplary embodiment of the present disclosure. A detailed description regarding portions overlapping the above-mentioned description will be omitted.

In step 610, the moving device 100 may start a docking into the docking station 200. The moving device 100 may start a docking if a condition to start a docking is satisfied. For example, a condition to start a docking may be satisfied when the amount of a fluid received in the storage tank of the moving device 100 is equal to or less than a predetermined value.

In step 620, when the moving device 100 is docked, the fluid supply system 10 of a docking station for a moving device may be configured to determine whether the moving device 100 has been successfully docked. The fluid supply system 10 of a docking station for a moving device may be configured to control the pump 220 to operate with a test operation load lower than an operation load. The fluid supply system 10 of a docking station for a moving device may be configured to determine, based on the amount of a fluid discharged from the third storage tank 120 and the amount of a fluid introduced into the first storage tank 110, whether the moving device 100 has been successfully docked while the pump 220 operates with a test operation load.

In step 630, when the moving device 100 has been successfully docked, the fluid supply system 10 of a docking station for a moving device may be configured to control the pump 220 to operate with an operation load, so that a fluid is supplied from the storage tank of the docking station 200 to the storage tank of the moving device 100.

In step 640, while the pump 220 operates with an operation load, the fluid supply system 10 of a docking station for a moving device may be configured to check, based on the flow rate of the first storage tank 110 and the flow rate of the third storage tank 120, a docking state of the moving device 100.

Figure 7:
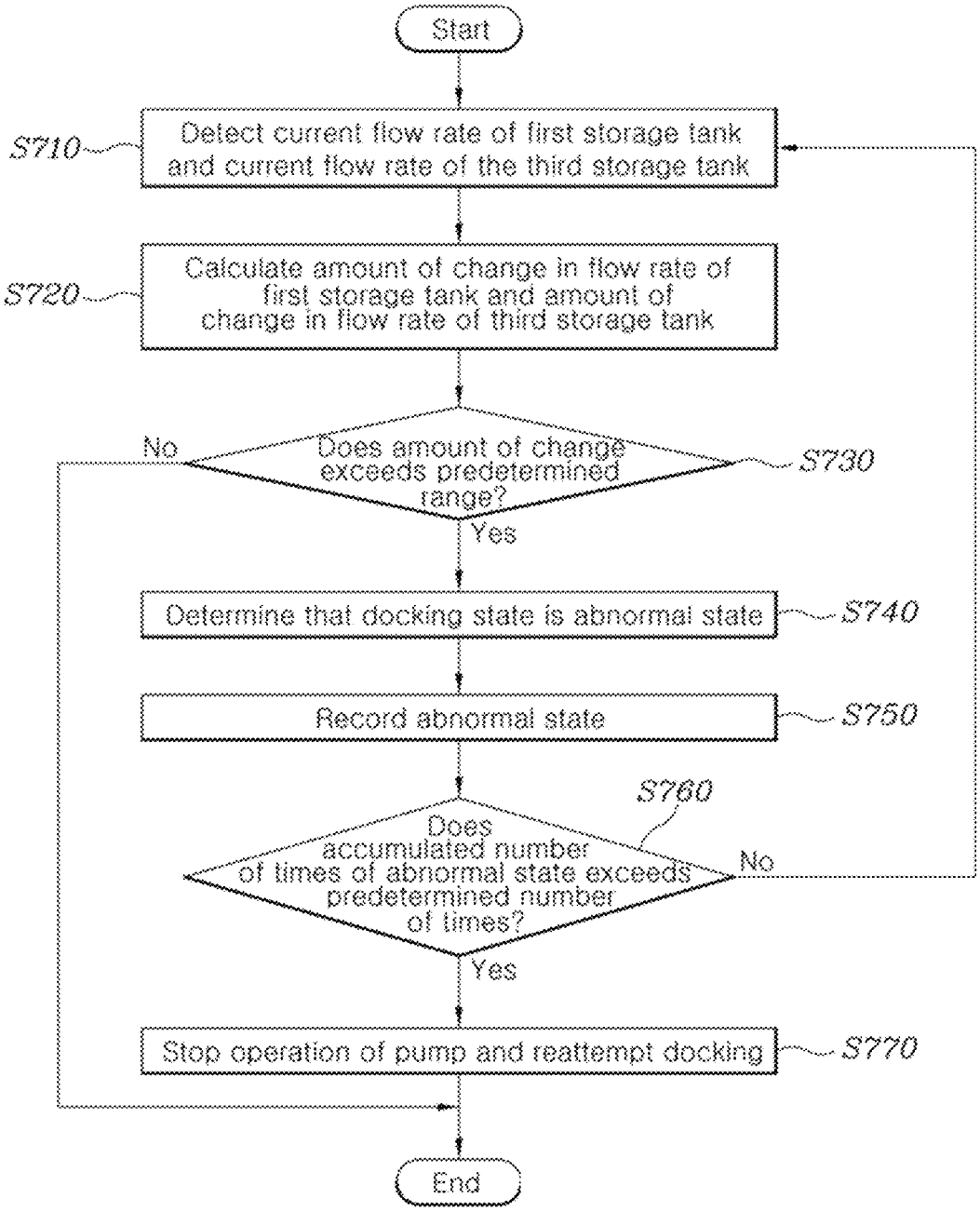
FIG. 7 is a flowchart of a method for checking a docking state according to a method of controlling a fluid supply system of a docking station for a moving apparatus illustrated in FIG. 6.

FIG. 7 is a flowchart of a method for checking a docking state according to a method of controlling a fluid supply system 10 of a docking station for a moving device illustrated in FIG. 6.

In step 710, the fluid supply system 10 of a docking station for a moving device may detect a current flow rate of the first storage tank 110 of the moving device 100 and a current flow rate of the third storage tank 120 of the docking station 200. The flow rate of the first storage tank 110 may mean the amount of a fluid introduced into the first storage tank 110, and the flow rate of the third storage tank 120 may mean the amount of a fluid discharged from the third storage tank 120.

In step 720, the fluid supply system 10 of a docking station for a moving device may determine a change amount in a flow rate of the first storage tank 110 and a change amount in a flow rate of the third storage tank 120. The change amount in a flow rate may be determined from the amounts of fluids received in the first storage tank 110 and the third tank 120 according to a predetermined time cycle.

In step 730, whether a difference between a change amount in a flow rate of the first storage tank 110 and a change amount in a flow rate of the third storage tank 120 exceeds a predetermined range may be determined. The fluid supply system 10 of a docking station for a moving device may determine whether the [equation 1] is satisfied.

If a difference between the amounts of changes in the flow rates does not exceed a predetermined range, it may be determined that a docking state of the moving device 100 is normal, and thus the checking with respect to the docking state may be finished.

If a difference between the amounts of changes in the flow rates exceeds a predetermined range, in step 740, it may be determined that a docking state thereof is abnormal, and in step 750, the abnormal state may be recorded. In other words, if a docking state thereof is abnormal, the difference between the amount of a fluid discharged from the third storage tank 120 and the amount of a fluid introduced into the first storage tank 110 may exceed a predetermined range. Therefore, a docking state thereof may be checked based on the difference.

In step 760, whether the accumulated number of times of an abnormal state exceeds a predetermined number of times may be determined. The duration time of an abnormal state instead of the accumulated number of times of an abnormal state may be determined.

If the accumulated number of times of an abnormal state does not exceed a predetermined number of times, the step 710 may be performed again, and accordingly the checking of a docking state thereof may be performed.

If the accumulated number of times of an abnormal state exceeds a predetermined number of times, in the step 770, the fluid supply system 10 in a docking station for a moving device may stop an operation of the pump 220, and may reattempt the docking of the moving device 100.

Furthermore, the term related to a control device such as "controller", "control apparatus", "control unit", "control device", "control module", or "server", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present disclosure. The control device according to exemplary embodiments of the present disclosure may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors. The processor may include various logic circuits and operation circuits, may process data according to a program provided from the memory, and may generate a control signal according to the processing result.

The control device may be at least one microprocessor operated by a predetermined program which may include a series of commands for carrying out the method included in the aforementioned various exemplary embodiments of the present disclosure.

The aforementioned invention can also be embodied as computer readable codes on a computer readable recording medium. The computer readable recording medium is any data storage device that can store data which may be thereafter read by a computer system and store and execute program instructions which may be thereafter read by a computer system. Examples of the computer readable recording medium include Hard Disk Drive (HDD), solid state disk (SSD), silicon disk drive (SDD), read-only memory (ROM), random-access memory (RAM), CD-ROMs, magnetic tapes, floppy discs, optical data storage devices, etc and implementation as carrier waves (e.g., transmission over the Internet). Examples of the program instruction include machine language code such as those generated by a compiler, as well as high-level language code which may be executed by a computer using an interpreter or the like.

In various exemplary embodiments of the present disclosure, each operation described above may be performed by a control device, and the control device may be configured by a plurality of control devices, or an integrated single control device.

In various exemplary embodiments of the present disclosure, the control device may be implemented in a form of hardware or software, or may be implemented in a combination of hardware and software.

Furthermore, the terms such as "unit", "module", etc. Included in the specification mean units for processing at least one function or operation, which may be implemented by hardware, software, or a combination thereof.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described to explain certain principles of the present disclosure and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. A fluid supply system of a docking station for a moving apparatus, the fluid supply system comprising:

the moving apparatus including a first storage tank configured to receive a fluid therein;

the docking station into which the moving apparatus is selectively docked, the docking station including a second storage tank configured to receive the fluid therein and a pump configured to discharge the fluid received in the second storage tank; and a processor electrically connected to the pump and configured to determine whether the moving apparatus is successfully docked to the docking station, and configured to control the pump to operate with an operation load when the processor concludes that the moving apparatus has been successfully docked into the docking station so that the fluid is supplied from the second storage tank to the first storage tank, wherein the processor is configured to control the pump to operate with a test operation load lower than the operation load to determine whether the moving apparatus has been successfully docked into the docking station, wherein when a difference between an amount of the fluid discharged from the second storage tank and an amount of the fluid introduced into the first storage tank is smaller than a predetermined amount, the processor is configured to conclude that the moving apparatus has been successfully docked into the docking station, and to control the pump to operate with the operation load, and wherein when the difference between the amount of the fluid discharged from the second storage tank and the amount of the fluid introduced into the first storage tank is greater than the predetermined amount, the processor is configured to determine that the moving apparatus has not been successfully docked into the docking station and to transfer a signal to the moving apparatus to reattempt a docking thereof.

2. The fluid supply system of claim 1, wherein while the pump operates with the operation load, the processor is configured to check a docking state of the moving apparatus, based on a flow rate of the first storage tank and a flow rate of the second storage tank.

3. A fluid supply system of a docking station for a moving apparatus, the fluid supply system comprising:

the moving apparatus including a first storage tank configured to receive a fluid therein;

the docking station into which the moving apparatus is selectively docked, the docking station including a second storage tank configured to receive the fluid therein and a pump configured to discharge the fluid received in the second storage tank; and a processor electrically connected to the pump and configured to determine whether the moving apparatus is successfully docked to the docking station, and configured to control the pump to operate with an operation load when the processor concludes that the moving apparatus has been successfully docked into the docking station so that the fluid is supplied from the second storage tank to the first storage tank;

wherein while the pump operates with the operation load, the processor is configured to check a docking state of the moving apparatus, based on a flow rate of the first storage tank and a flow rate of the second storage tank, wherein the moving apparatus includes a first detector electrically connected to the processor and configured to detect an amount of the fluid received in the first storage tank and to periodically transfer a signal of the detected amount of the fluid received in the first storage tank to the processor, wherein the docking station includes a second detector electrically connected to the processor and configured to detect an amount of the fluid received in the second storage tank and to periodically transfer a signal of the detected amount of the fluid received in the second storage tank to the processor, and wherein the processor is configured to periodically determine the flow rate of the first storage tank and the flow rate of the second storage tank, according to the signals received from the first detector and the second detector.

4. The fluid supply system of claim 3, wherein the processor is configured to determine that the docking state of the moving apparatus is an abnormal state when [equation 1] below is satisfied, and to stop the operation of the pump when the abnormal state persists for a predetermined time period or longer than the predetermined time period, or when a configured number of times is exceeded, $$\sum_{k=1}^{n}(|B_k - B_{k-1}| - |A_k - A_{k-1}|) > \delta \quad \text{[equation 1]}$$

wherein $A_0$ is an initial amount of a fluid received in the first storage tank, $A_n$ is a value of an n-th signal received from the first detector, $B_0$ is an initial amount of a fluid received in the second storage tank, $B_n$ is a value of an n-th signal received from the second detector, and $\delta$ is a reference value.

5. The fluid supply system of claim 1, wherein when the amount of the fluid received in the first storage tank is equal to or greater than a first threshold value, or when an amount of the fluid received in the second storage tank is equal to or smaller than a second threshold value, the processor is configured to stop the operation of the pump.

6. The fluid supply system of claim 1, further including a leakage detector configured to detect a leakage of the fluid between the moving apparatus and the docking station.

7. A fluid supply system of a docking station for a moving apparatus, the fluid supply system comprising:

the moving apparatus including a first storage tank configured to receive a fluid therein;

the docking station into which the moving apparatus is selectively docked, the docking station including a second storage tank configured to receive the fluid therein and a pump configured to discharge the fluid received in the second storage tank; and a processor electrically connected to the pump and configured to determine whether the moving apparatus is successfully docked to the docking station, and configured to control the pump to operate with an operation load when the processor concludes that the moving apparatus has been successfully docked into the docking station so that the fluid is supplied from the second storage tank to the first storage tank; and a leakage detector configured to detect a leakage of the fluid between the moving apparatus and the docking station;

wherein the leakage detector includes a first circuit portion disposed on the moving apparatus and a second circuit portion disposed into the docking station, wherein when the moving apparatus has been docked into the docking station, the first circuit portion and the second circuit portion are disposed at a point at which the first circuit portion and the second circuit portion face each other, and wherein when a part of the fluid flows into a gap between the moving apparatus and the docking station, the first circuit portion and the second circuit portion are electrically connected to each other to detect the leakage of the fluid.

8. The fluid supply system of claim 1, wherein the moving apparatus is an autonomous moving apparatus which drives autonomously, and wherein the moving apparatus is configured to autonomously dock, when a docking thereof is started, into the docking station, and to reattempt the docking into the docking station when the operation of the pump is stopped when the processor concludes that a docking state of the moving device into the docking station is abnormal.

9. The fluid supply system of claim 1, wherein the moving apparatus further includes a third storage tank configured to receive wastewater therein, wherein the wastewater is discharged from the third storage tank when the moving apparatus is docked into the docking station, and wherein the processor is configured to detect a time required for discharging the wastewater in the third storage tank and record an abnormal log when the required time is equal to or greater than a predetermined time period.

10. A method for controlling a fluid supply system of a docking station for a moving apparatus, the method comprising:

starting, by the moving apparatus, a docking of the moving apparatus into the docking station;

when the moving apparatus has been docked, determining, by a processor, whether the moving apparatus has been successfully docked into the docking station; and controlling, by the processor, a pump of the fluid supply system to operate with an operation load, when the processor concludes that the moving apparatus has been successfully docked so that a fluid is supplied from a second storage tank of the docking station to a first storage tank of the moving apparatus, wherein, in the determining of whether the moving apparatus has been successfully docked, the pump is controlled by the processor to operate with a test operation load lower than the operation load to determine whether the moving apparatus has been successfully docked, wherein when a difference between an amount of the fluid discharged from the second storage tank and an amount of the fluid introduced into the first storage tank is smaller than a predetermined amount, the processor is configured to determine that the moving apparatus has been successfully docked into the docking station, and to control the pump to operate with the operation load, and wherein when the difference between the amount of the fluid discharged from the second storage tank and the amount of the fluid introduced into the first storage tank is greater than the predetermined amount, the processor is configured to determine that the moving apparatus has not been successfully docked into the docking station and to transfer a signal to the moving apparatus to reattempt a docking thereof.

11. The method of claim 10, further including checking, based on a flow rate of the first storage tank and a flow rate of the second storage tank, a docking state of the moving apparatus while the pump operates with the operation load.

12. The method of claim 10, wherein when the amount of the fluid received in the first storage tank is equal to or greater than a first threshold value, or when an amount of the fluid received in the second storage tank is equal to or smaller than a second threshold value, the processor is configured to stop the operation of the pump.

13. A non-transitory computer readable storage medium on which a program for performing the method of claim 10 is recorded.

* * * * *